United States Patent [19]

Kawanami

[11] 4,056,960

[45] Nov. 8, 1977

[54] MEANS AND METHOD FOR BENDING ELONGATED MATERIALS INCORPORATING TWO ARMS

[76] Inventor: Shunpei Kawanami, 45-4 Shindo, Hiratsuka, Kanagawa, Japan

[21] Appl. No.: 709,928

[22] Filed: July 29, 1976

Related U.S. Application Data

[62] Division of Ser. No. 593,961, July 8, 1975.

[30] Foreign Application Priority Data

July 23, 1974 Japan ..... 49-83756

[51] Int. Cl.[2] ..... B21D 7/16

[52] U.S. Cl. ..... 72/128; 72/310; 72/318; 72/369

[58] Field of Search ..... 72/128, 149, 145, 152, 72/155, 310, 318, 342, 364, 369, DIG. 22, 12, 17, 702

[56] References Cited

U.S. PATENT DOCUMENTS

| | | | |
|---|---|---|---|
| 2,286,893 | 6/1942 | Boissou | 72/128 |
| 2,812,004 | 11/1957 | Huet | 72/128 |
| 3,328,988 | 7/1967 | Schmidt | 72/128 |
| 3,352,136 | 11/1967 | Clarke | 72/702 |
| 3,368,377 | 2/1968 | Hirayama et al. | 72/128 |
| 3,896,649 | 7/1975 | Stuart | 72/128 |
| 3,902,344 | 9/1975 | Stuart | 72/128 |

*Primary Examiner*—E. M. Combs

*Attorney, Agent, or Firm*—Burns, Doane, Swecker & Mathis

[57] ABSTRACT

A means and method for bending elongated materials having a device for locally heating a portion of the material and a freely pivotable bending arm, is provided with a second arm for advancing the elongated material past the heating device and, in cooperation with the pivotable arm, exerting a bending moment on the locally heated portion of the material.

7 Claims, 6 Drawing Figures

MEANS AND METHOD FOR BENDING ELONGATED MATERIALS INCORPORATING TWO ARMS

RELATED APPLICATION

This is a divisional application of pending prior application Ser. No. 593,961 filed on July 8, 1975.

BACKGROUND OF THE INVENTION

Referring first to FIG. 1, a known conventional bending apparatus is shown. In the figure reference numeral 1 designates a steel pipe to be bent; a support block 2 is adapted to support the pipe end and formed integral with the means for continuously and straightforwardly propelling the steel pipe 1. Also provided are a pair of guide rolls 3 and 4 and a heating device 5 such as an annular high frequency inductor which is capable of heating a limited area of the steel pipe 1 sidewise to a high temperature, a cooling device 6 integral with said heating device, a bending arm 7, the pivotal shaft 8 of the arm 7 arranged such that its center resides within the plane of the heating device 5, and a clamp 9 fixed to the arm 7.

In operation of the apparatus just described, steel pipe 1 is first passed between guide rolls 3 and 4 and then further passed through heating device 5 as shown in the drawing. The pipe end is supported by support block 2 of the propelling means, and in certain applications, an end or a suitable middle portion of the steel pipe 1 is fastened to the arm 7 by the clamp 9. The steel pipe 1 is continuously fed straightforwardly by the propelling means while subjected to local heating by heating device 5 to a plastic deformation inducing temperature, and this treatment is immediately followed by cooling so as to effect continuous plastic deformation of the steel pipe 1 in its heated area while giving a bending movement to the pipe by the thrust of the propelling means under the guidance of the arm 7, thereby to accomplish the desired bending. Thus, according to this apparatus, the desired bending of steel pipe can be performed at high efficiency without requiring any elaborate thermal works. The same effect can be obtained by using this apparatus for bending of other types of metal pipes or metal strips. It is to be particularly noted that no bending mold is required and it is possible to bend the pipe at any desired radius of curvature.

The above-described means and method has the disadvantages that it requires numerous rollers and a bending arm fixed to a strong frame in order to resist undesired movement when a bending moment is applied to the elongated material. As a result the apparatus is expensive to fabricate and difficult to make portable to permit on-site bending of materials.

Accordingly, it is an object of the present invention to provide a bending means which may be inexpensively fabricated.

It is another object of the present invention to provide a portable hot bender for elongated materials.

A demand has been voiced in the industry for a method and apparatus which is capable of bending elongated material with high precision.

Accordingly, it is still another object of the present invention to provide a high precision bending apparatus.

These and other objects and features of the invention will become apparent from the claims and from the following description when read in conjunction with the appended drawings.

THE DRAWINGS

Detailed Description

Figure 1:
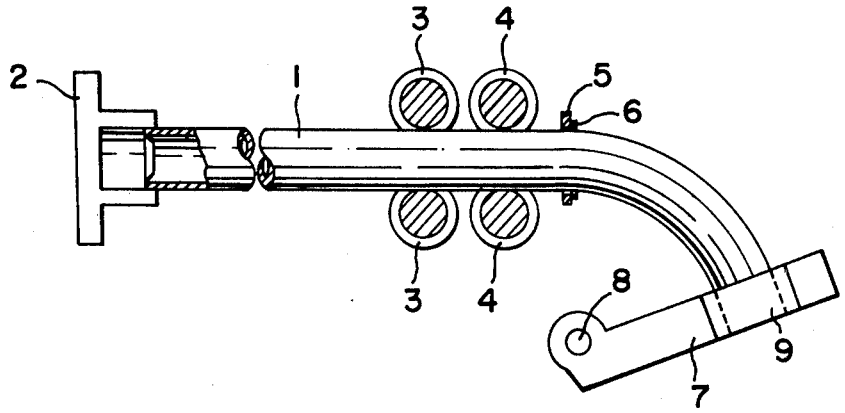
FIG. 1 (PRIOR ART)
FIG. 1 is a plan view of a known bending apparatus.

The device shown in FIGS. 2 to 5 is a material bending apparatus which is an improvement of the apparatus of FIG. 1. This apparatus comprises an annular heating device which heats to a high temperature a narrow area on the outer peripheral surface of a metal pipe or other metal strip to be bent and an annular cooling device. A bearer adapted to hold the fore end of the pipe or the like is provided on the swingable arm 7 arranged such that the pivotal shaft 87 thereof is located within the plane of the annular heating device, while another bearer adapted to hold the rear end of the pipe is provided on another arm. A traction means using screw, cable, chain or hydraulic means is disposed between a point on the arm at a distance substantially the length of bending radius away from the center of the pipe and a point of the arm shaft support at a distance substantially the length of bending radius away from the center of the pipe.

Figure 4:
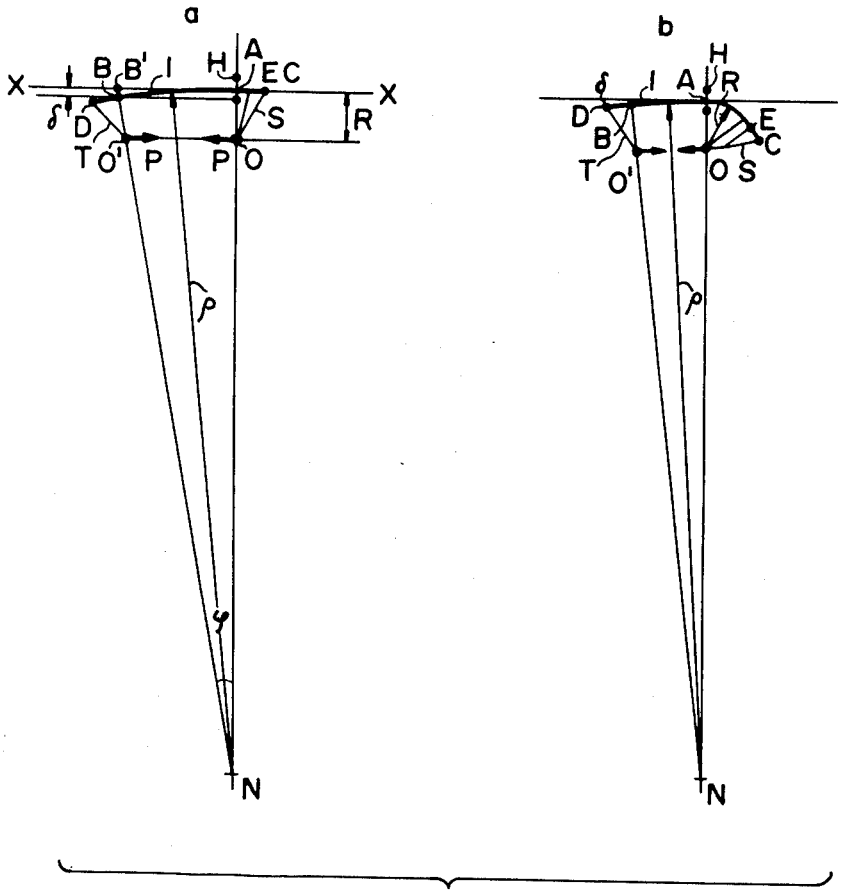
FIG. 4 is a drawing for illustrating the principles of the apparatus of FIG. 2.

Now with reference to FIG. 4, A is a point at which bending of pipe 1 is started, B is the rear end of pipe 1, C is the fore end of pipe 1, D is a point which may be coincident with point B or may be positioned slightly therebehind, E is a point on pipe 1 positioned close to point A when bending starts, O is the center of bend, and H is annular heating device attached with cooling device. This annular heating device may be substantially identical with heating device 5 is the apparatus of FIG. 1 and arranged around point A. S is an arm forming a triangle OEC and adapted to regulate movement of the fore end of pipe 1, and T is an arm forming a triangle OBD and adapted to fix the rear end of pipe 1. Heating device H is arranged to heat a narrow area on pipe 1, and the heated area is immediately cooled. Arm S is swingable about the point O, and the segment O–O′ connecting the ends O and O′ of respective arms S and T is parallel to the center line X—X of pipe 1 before the bending moment is applied thereto. Thus, when mutually pulling forces are acted between the ends O and O′ of said arms S and T while heating the pipe 1 by heating device H, with the distance X—X being equalized to the bending radius, the pipe 1 is bent. The pulling forces acting between the points O and O′ before heating is started at point A causing the pipe 1 to be deformed are shown by arrows P in FIG. 4 (*a*).

The line DA represents the unbent portion of the material which may be flexed slightly and therefore slightly curved.

Here, if it is assumed that the pulling force acting between points O and O′ is *P*, the bending radius is *R* and bending moment produced at point $A$ is $M$, then the following relation exists always:

$$M = PR \quad (1)$$

Therefore, if heating temperature at point $A$ is kept constant, $M$ also becomes constant, so that bending can be continued by advancing the pipe 1 while keeping $P$ constant. On the other hand, if it is assumed that the distance $BB'$ of point $B$ from the straigth line X—X is $\delta$, this $\delta$ varies proportionally to the length $BA$, that is, it is gradually reduced as the length $BA$ diminishes as shown in FIG. 4(*b*).

Therefore, it is usually necessary to change the length of arm $T$, that is, the length $O'B$ is in accordance with advancement of bending, and to make curve $BA$ contact the line X—X at point $A$, but according to the present invention, since work is carried out by performing local heating at point $A$, the bending moment applied to the pipe 1 is extremely small, and hence flexure at the pipe end $B$ is extremely small as compared with the pipe length $AB$. For instance, in the case of a pipe with outer diameter of 165.2 mm, thickness of 5 mm and length of 5.5 mm, flexure that develops at the pipe end $B$ in the bending work is merely about 5 cm, which is less than 1 percent of the pipe length $AB$ and hence almost negligible.

Therefore, desired bending can be accomplished if the apparatus is contructed so as to satisfy the above-said conditions, but for performing high precision bending work where no flexure is allowed, the following measures are taken. That is, since the moment produced in the pipe is substantially uniform and constant, that is, $M$ is substantially equal to $PR$ as said above, and the curve $BA$ becomes an arc of the circle having a constant radius of curvature $\rho$, it is only required to make control such that the center point $B$ of the pipe end moves on the arc of the circle. By so doing, the curve $BA$ is always in contact with the line X—X and hence it becomes possible to maintain the bending radius $R$ constant while substantially excluding flexure at the pipe end.

Figure 2:
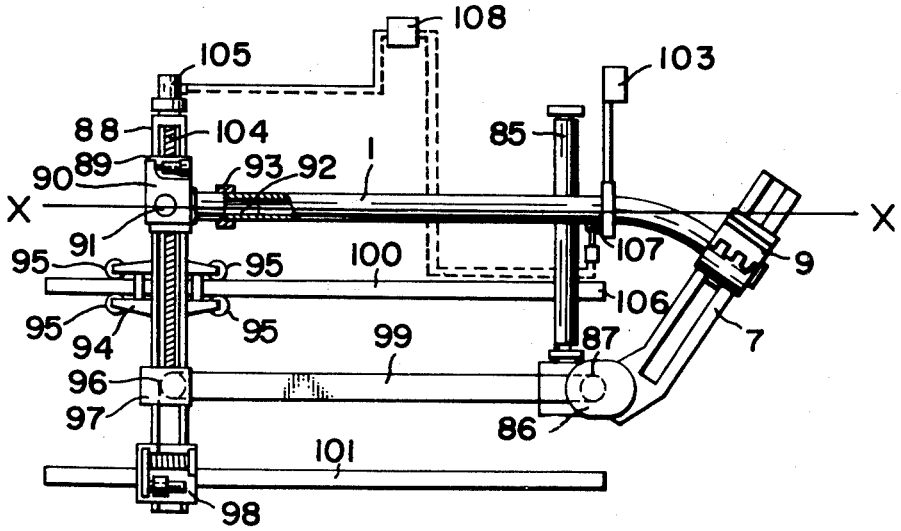
FIG. 2 is a plan view of an embodiment of the present invention.
Figure 3:
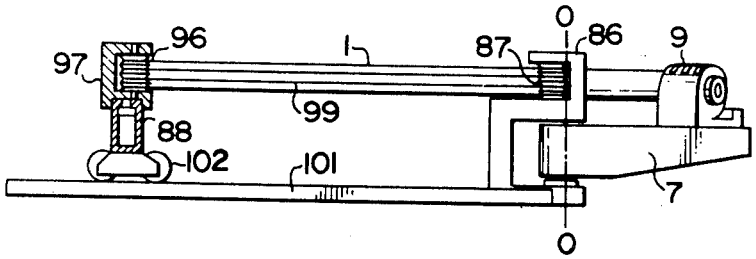
FIG. 3 is a front elevation in partial section of the apparatus shown in FIG. 2.

Shown in FIGS. 2 and 3 is an example of apparatus which incorporates the above-described principles. In the Figures, numeral 85 designates the rolls carrying the steel pipe 1 which are adjustable in height, 86 a support which supports the arm shaft 8, and 87 a pulley disposed at an upper part of the support 86 and concentric with the axis of rotation $O$ of the arm 7 or centered nearby. The lower part of the support 86 terminates in a bearing for the shaft 8 and the upper part terminates in a bearing for the pulley 87. An arm 88 which is substantially same as the arm $T$ shown in FIG. 4, a base 89 mounted on the arm 88, a boss 90 mounted on base 89 so as to be turnable through a small angle by a shaft 91, and a core 92 supported integrally with the boss 90 are also provided.

The fore end portion of the core 92 is loosely fitted into the steel pipe 1 while the rear end portion is formed equal in diameter to the steel pipe 1 so that the end of the pipe 1 and the core 92 may be held together by a clamp 93. A support leg 94 of the arm 88, rollers 95 mounted in two sets of two on the support leg 94, a pulley 96 mounted on the arm 88 through the support 97, a winch 98 disposed on the arm 88, a cable 99 passed round the pulleys 87 and 96 so as to be wound up by the winch 98, and guide rails 100 and 101 for maintaining the arm 88 vertical or substantially vertical to the line X—X are provided. The guide rail 100 is so arranged that the rollers 95 of the support leg 94 will hole the rail, while another guide rail 101 is arranged to guide the roller 102 provided at the bottom of the mount of the winch 98. The arm 88 and support leg 94 are so mounted that they are turnable through a small angle with the pulleys 87 and 96 arranged so that the line connecting their mounting axes is parallel to the guide rails 100, 101 and positioned at a point distant the length of bending radius away from the center of the steel pipe 1. A high frequency transformer 103 is provided for the heating device 5. A bolt 104 is disposed rotatable at the fixed position on the arm 88 and threadedly passed through the base 89. A motor 105 has its shaft connected to the bolt 104. A detector 106 having rotatably mounted thereon a roller 107 lightly in contact with the steel pipe 1 is positioned adjacent the material to detect displacement of the material 1 to issue a signal corresponding to such displacement. An output converter device 108 for rotating motor 105 either forwardly or reversely according to the signal issued from the detector 106 is also provided. This converter is electrically connected to the motor 105 and the detector 106.

The core 92 is supported integrally with the rotatable boss 90 for allowing generation of sufficient bending moment without changing the tilt of arm 88 during the bending even if the fitting of the core 92 and steel pipe 1 is loosened. This support also allows for easy withdrawal of the core 92 from the steel pipe 1 by loosening the fit thereof by slightly turning the boss 90 reversely upon completion of the bending. The rear end of the steel pipe 1 may be clamped by the same clamp 9 as used for the front end, but use of the core facilitates removal of the steel pipe 1 upon completion of the bending work and is also useful for preventing contact of the steel pipe 1 with the heating device 5.

According to the above-described apparatus, steel pipe 1 is moved at a constant speed by producing bending moment directly in the pipe by winding up the steel cable 99 by the winch 98 so that the pulling forces are acted directly between the pulleys 87 and 96 in a way to twist the pipe 1. In the meanwhile, steel pipe 1 is locally heated by heating device 5 so that bending occurs continuously in the heated portion of the pipe. These steps are sufficient for bending work of pipes for which normal degree of precision is required, the control means 104 may be used.

These control means are designed to keep the center of the boss mounting shaft 91 (corresponding to the pipe end $B$ in FIG. 22) substantially on the arc of the circle $BA$ so that even if the steel pipe 1 flexes, its center line stays in contact with the original center line X—X at the heating point $A$ of heating device 5, thereby to maintain the bending radius $R$ of the pipe 1 constant. Thus, if steel pipe 1 is displaced to push roller 107, detector 106 detects it and issues a positive signal to actuate motor 105 to rotate forwardly through output converter 108 to move the center of the boss mounting shaft 91 toward the line X—X through screw 104 so that roller 107 will not substantially be forced out from the set position. If steel pipe 1 attempts to separate from roller 107, the detector 106 detects it and issues a negative signal to perform adjustment just contrary to the above-said. Generally, the pipe advancing speed in bending work of pipes is slow and displacement such as above-mentioned takes place very slowly, so that very stabilized control can be accomplished by using the control means.

Figure 5:
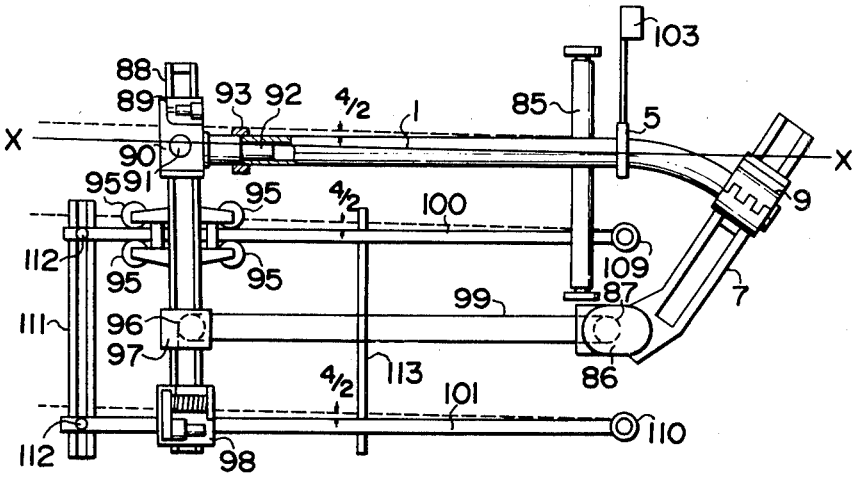
FIG. 5 is a plan view of a modification of the apparatus shown in FIG. 2.

Shown in FIG. 5 is also a bending apparatus which is basically of the same construction as the apparatus shown in FIGS. 2 and 3. The difference is that the right ends of guide rails 100, 101 are supported by rotatable pin joints 109, 110 which are so arranged that the center of their rotation is within the plane of heating device 5, i.e., approximately on the line *CO* in FIG. 4, while the left ends of guide rails 100, 101 are fixed to channel-shaped rails 111 by bolts and nuts 112. The angle made by these guide rails 100, 101 and the original center line X—X of steel pipe 1 is adjusted to become equal to the angle $\phi/2$ which is made by the lines *BA* and X—X and wherein $\phi$ is the angle of $\angle$ *BNA* where *N* is center of curvature of the arc *BA* in FIG. 22 (*a*), whereby the amount of flexure at the center point of left end of steel pipe 1, that is, at point *B* in FIG. 22(*a*), is adjusted to become $\delta$, and then the bending is carried out.

In making the adjustment, both front and rear ends of steel pipe 1 are fixed to arms 7, 88, respectively and, with bolt and nuts 112, being kept loose, a predetermined amount of tension is applied between arms 7 and 88 by winch 98. The guide rails 100, 101 are tilted so that the angle made by steel pipe 1 and its original center line X—X will become $\phi/2$, which is followed by stoppage of said winch 98 and the final fixing of bolt and nuts 112. The values of $\phi$ and $\delta$ can be easily calculated by using a calculation formula of radius of curvature and flexure relating to the beams to which the simple moment has been applied.

Figure 6:
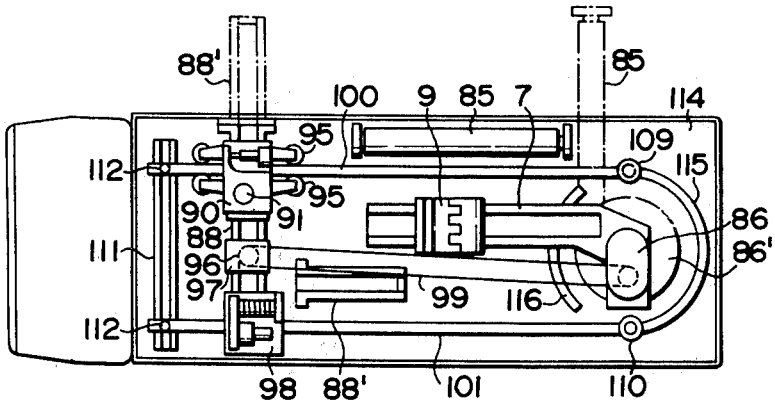
FIG. 6 is a plan view of the apparatus of FIG. 5 which has been modified to be transportable and is here shown carried on the bed of a truck.

FIG. 6 shows still another modification in which arm 88 in the apparatus of FIG. 5 is split into two portions 88 and 88', connected to each other. It is to be also noted that roller 85 is arranged movable while the support 86 supporting the arm 7 is fixed on a disc 86'. This disc 86' is arranged pivotable 90° counterclockwise about the center *O* of turn of the arm 7 to let the support 86 turn 90° counterclockwise from the direction shown in FIG. 23 and thus place it on the bed 114 of a truck or the like. Thus, if roller 85 is placed outside of the parallel to guide rail 100 while placing arm 88' inside of and parallel to guide rail 101, the arm 881 can be properly placed on the bed 114.

In the figure, the circular rails 115 and 116 rollably support receiving rolls (not shown) extending from arm 7 for preventing the support 86 and disc 86' from being located with the weight of arm 7. Although heating device 5 is not shown in FIG. 6, it may be fixed to a high frequency transformer and these means may be arranged movable by a suitable method and connected to the apparatus when the latter is used.

In the three apparatuses shown in FIG. 2 to 6 is that, since bending is started while applying a bending moment to steel pipe 1, it must be attempted to prevent formation of a bulge in the heated portion of the pipe either by driving the winch 98 immediately before plastic deformation takes place in the pipe 1.

In the bending apparatus such as shown in FIG. 1, the apparatus may be damaged if thrust is applied to steel pipe 1 before the heating temperature rises up sufficiently. However, in any of the above-described apparatus of the present invention, the portion where load is applied is limited to a very small area and it is easy to make such portion strong enough to withstand damage, so that any slight misoperation does not lead to damage to the apparatus. Also, the apparatus can be extremely reduced in weight and no solid supportive frame work is required, so that the apparatus of the present invention, like the one shown in FIG. 6, can be transported. Use of such transportable apparatus can greatly facilitate bending work on steel pipes or the like at the work sites.

The principles, preferred embodiments, and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without deporting from the spirit and scope of the present invention.

What is claimed is:

1. An apparatus for bending elongated materials, comprising:

a. heating means for locally heating a portion of the material;

b. an arm which is freely pivotable about an axis, the pivotable arm including means for clamping a leading portion of the material; and, c. means for advancing the material past said heating means, and for applying a bending moment to said material in cooperation with said pivotable arm including:

a second arm;

a bearer connected to said second arm for engaging a portion of said material not yet advanced past the heating means;

guide means for maintaining the second arm in an orientation approximately vertical to the principal axis of the unbent portion of the material; and, traction means for moving the second arm toward the axis of the pivotable arm.

2. The apparatus of claim 1 further comprising means for moving the bearer along the longitudinal axis of the second arm responsive to displacement of the unbent portion of the material adjacent the heating means.

3. The apparatus of claim 2 wherein the unbent portion of the material is flexed in an arc, a tangent of which, taken approximately at the point where the material passes the heating means, is maintained by the second arm approximately perpendicular to a line passing through the heating means and the axis of the pivotable arm.

4. The apparatus of claim 1 wherein said guide means includes at least one guide rail on which the second arm moves with the longitudinal axis of the second arm approximately perpendicular thereto, said guide rail being pivotable about an axis lying in a line passing through the heating means and the axis of the pivotable arm.

5. In a hot bending method for bending elongated material in which elongated material to be worked is passed through an annular heating means for heating the material to a high temperature in a limited area with a leading portion of the material being clamped to an arm pivotable about an axis within the plane of the heating means, the arm having a length approximately equal to the bending radius of the pipe, and then continuously and straightforwardly advancing the pipe while heating the pipe locally by the heating device to a plastic inducing temperature to cause continuous plastic deformation in the heated area of the pipe, the improvement wherein a trailing unbent portion of the material is clamped to a second arm and advanced toward the heating means so that the unbent portion is flexed in an arc, a tangent of which is maintained approximately perpendicular to the plane of the annular heating means.

6. A metal material bending apparatus comprising annular heating means for heating metal material to be bent, annular cooling menas for cooling said material, a bearer adapted to hold a first end portion of said material and provided on a swingable arm, the axis of swing of said arm being positioned within the plane of said annular heating means, another bearer adapted to hold an end portion of said material and provided on a second arm, and traction means for moving the second arm in a direction substantially perpendicular to the second arm's longitudinal axis, said traction means being disposed beween the axis of said swingable arm and a point on said second arm, said point being located approximately the length of the bending radius from the end portion of said material.

7. A bending apparatus as set forth in claim 6 further including means for detecting movement of the metal material to be bent in the plane of the annular heating means, said means being disposed adjacent to said heating means, and means responding to operation of said detecting means to move the bearer on said second arm so as to correct displacement of said material.

* * * * *